US007877856B2

(12) United States Patent
Fukuyama et al.

(10) Patent No.: US 7,877,856 B2
(45) Date of Patent: Feb. 1, 2011

(54) METHOD OF MANUFACTURING A SPEAKER

(75) Inventors: Takanori Fukuyama, Mie (JP); Tomoyasu Takase, Mie (JP); Koji Sano, Mie (JP); Hiroshi Yano, Mie (JP); Masanori Nakano, Mie (JP); Shigeru Tomoeda, Mie (JP); Kazuki Honda, Mie (JP); Kazuya Yamasaki, Osaka (JP); Kazutaka Kubo, Mie (JP); Takeshi Shimokawatoko, Mie (JP); Mitsutaka Enomoto, Mie (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 28 days.

(21) Appl. No.: 12/464,530

(22) Filed: May 12, 2009

(65) Prior Publication Data

US 2009/0217509 A1 Sep. 3, 2009

Related U.S. Application Data

(62) Division of application No. 10/590,144, filed as application No. PCT/JP2005/004763 on Mar. 17, 2005, now Pat. No. 7,548,632.

(30) Foreign Application Priority Data

Mar. 31, 2004 (JP) ..... 2004-103775
Jul. 5, 2004 (JP) ..... 2004-197561

(51) Int. Cl.
*H04R 31/00* (2006.01)

(52) U.S. Cl. ..... 29/594; 29/592.1; 29/609.1; 181/157; 181/166; 181/167; 181/171; 181/173; 381/120; 381/182; 381/396; 381/398; 381/403

(58) Field of Classification Search ..... 29/592.1, 29/594, 609.1; 181/157, 166, 167, 171–173; 381/120, 182, 396, 398, 403, 423, 426, 429, 381/430

See application file for complete search history.

(56) References Cited

U.S. PATENT DOCUMENTS 4,122,314 A 10/1978 Matsuda et al.

(Continued)

FOREIGN PATENT DOCUMENTS

GB 2 348 336 9/2000

(Continued)

OTHER PUBLICATIONS

European Search Report issued Oct. 13, 2009 in EP application 05 72 6703, which is a counterpart to the present application.

(Continued)

*Primary Examiner*—Paul D Kim
(74) *Attorney, Agent, or Firm*—Wenderoth, Lind & Ponack, L.L.P.

(57) ABSTRACT

An edge (29) for supporting a diaphragm assembly (100) with respect to a frame (26) is bonded to the frame (26) along the outer periphery thereof and joined to a diaphragm (27) in a position more peripherally inward than a voice coil (28) along the inner periphery thereof. The edge (29) partly overlaps diaphragm (27). This structure allows downsizing of the speaker, without reducing the sizes of a permanent magnet (21) and the edge (29).

2 Claims, 10 Drawing Sheets

U.S. PATENT DOCUMENTS

| | | | | |
|---|---|---|---|---|
| 5,062,140 | A | 10/1991 | Inanaga et al. | |
| 5,521,886 | A | 5/1996 | Hirosawa et al. | |
| 5,850,462 | A | 12/1998 | Sakamoto et al. | |
| 5,883,967 | A | 3/1999 | House | |
| 6,031,925 | A | 2/2000 | Shteyn | |
| 6,757,403 | B2 * | 6/2004 | Urushibata et al. | 381/418 |
| 2002/0064293 | A1 | 5/2002 | Kobayashi et al. | |
| 2003/0031337 | A1 | 2/2003 | D'Hoogh | |
| 2003/0112995 | A1 | 6/2003 | Frasl | |
| 2004/0228500 | A1 | 11/2004 | Stiles | |

FOREIGN PATENT DOCUMENTS

| | | | |
|---|---|---|---|
| JP | 54-143231 | | 10/1979 |
| JP | 55-046649 | | 4/1980 |
| JP | 55-76589 | | 5/1980 |
| JP | 57-64988 | | 4/1982 |
| JP | 57-111196 | | 7/1982 |
| JP | 61108299 | A * | 5/1986 |
| JP | 61-116499 | | 6/1986 |
| JP | 64-3396 | | 1/1989 |
| JP | 4-362900 | | 12/1992 |
| JP | 9-084180 | | 3/1997 |
| JP | 2001-251699 | | 9/2001 |
| JP | 2002-152895 | | 5/2002 |

OTHER PUBLICATIONS

Office Action issued Aug. 21, 2008 in parent U.S. Appl. No. 10/590,144.

Office Action issued Nov. 5, 2008 in parent application U.S. Appl. No. 10/590,144.

Notice of Allowance dated Apr. 3, 2009 in parent application Serial No. 10/590,144.

* cited by examiner

FIG. 16 – PRIOR ART

METHOD OF MANUFACTURING A SPEAKER

This application is a divisional of U.S. application Ser. No. 10/590,144, filed Aug. 21, 2006, now U.S. Pat. No. 7,548,632 which is a U.S. national phase application of PCT International Application PCT/JP2005/004763, filed Mar. 17, 2005.

TECHNICAL FIELD

The present invention relates to a speaker, a device using the speaker, and a method of manufacturing the speaker.

BACKGROUND ART

FIG. 16 is a sectional view of a conventional speaker disclosed in Unexamined Japanese Utility Model Publication No. 57-111196. Permanent magnet 1 is sandwiched between upper plate 2 and yoke 3 to form magnetic circuit assembly 4. Frame 6 is fitted to yoke 3. The outer periphery of edge 9 is attached onto frame 6. Voice coil 8 attached to diaphragm 7 is placed in magnetic gap 5 in magnetic circuit assembly 4. Diaphragm 7 and edge 9 along the outer periphery of diaphragm 7 are unitarily formed of one resin film sheet.

The problem with the above speaker is that its performance is deteriorated when the speaker is downsized to meet market requests, because the size of diaphragm 7, edge 9, or permanent magnet 1 must be reduced.

SUMMARY OF THE INVENTION

A speaker of the present invention includes: a magnet circuit assembly including a frame and a permanent magnet; a diaphragm assembly including a diaphragm, and a voice coil attached to the outer periphery of the diaphragm; and an edge that is attached to the frame along the outer periphery thereof and joined onto the diaphragm in a position more peripherally inward than the voice coil along the inner periphery thereof to partly overlap the diaphragm, and that supports the diaphragm assembly with respect to the frame. The edge partly overlaps the diaphragm. This structure allows the speaker to be downsized, without reducing the sizes of the permanent magnet and edge.

BRIEF DESCRIPTION OF THE DRAWINGS

FIG. 16 is a sectional view of a conventional speaker.

DETAILED DESCRIPTION OF PREFERRED EMBODIMENTS

Hereinafter, a description is provided of exemplary embodiments of the present invention with reference to the accompanying drawings.

First Exemplary Embodiment

Figure 1:
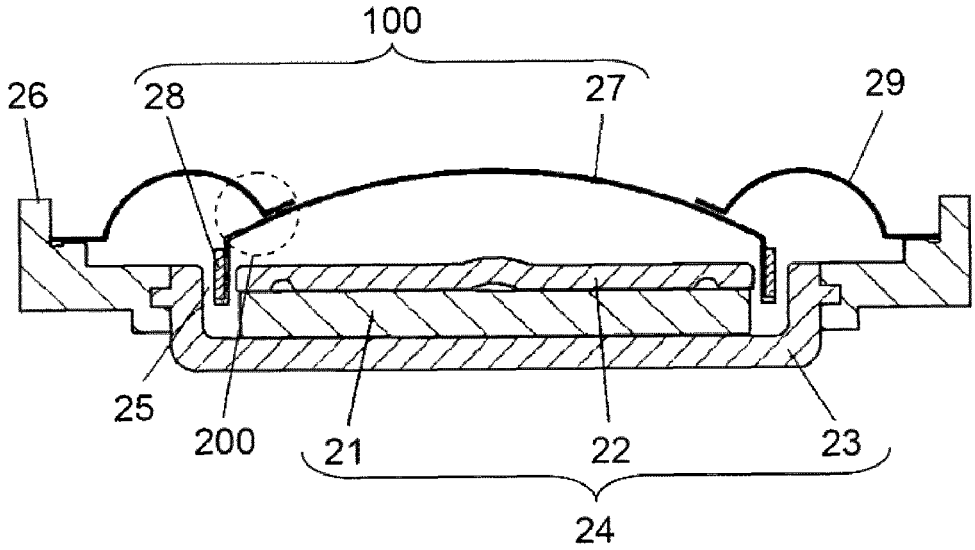
FIG. 1 is a sectional view of a speaker in accordance with a first exemplary embodiment of the present invention.

FIG. 1 is a sectional view of a speaker in accordance with the first exemplary embodiment of the present invention. Permanent magnet 21 is sandwiched between upper plate 22 and yoke 23 to form magnetic circuit assembly 24. Frame 26 is fitted to yoke 23. Diaphragm 27 and voice coil 28 attached to the outer periphery of diaphragm 27 form diaphragm assembly 100. Edge 29 supports diaphragm assembly 100 with respect to frame 26 so that voice coil 28 is placed in magnetic gap 25 in magnetic circuit assembly 24. Edge 29 is bonded to frame 26 along the outer periphery thereof, and joined to diaphragm 27 in a position more peripherally inward than voice coil 28 along the inner periphery thereof. Therefore, edge 29 partly overlaps diaphragm 27.

Now, the portion in which edge 29 overlaps diaphragm 27 is referred to as crossover portion 200. Crossover portion 200 is structured so that a portion in which edge 29 overlaps diaphragm 27 is ensured, other than the bonding portion, i.e. a joint of edge 29 and diaphragm 27. This structure can reduce the outer diameter of the speaker, without reducing the sizes of permanent magnet 21 and edge 29, and thus without deteriorating the performance of the speaker.

Diaphragm 27 and edge 29 are structured of a polymer film sheet made of polyethylene naphthalate (PEN), polyether imide (PEI), or polyamide imide (PAI), for example; a metal sheet; a cloth sheet; or a paper sheet. The use of these sheet materials is useful to improve the sound level and productivity of the speaker.

Diaphragm 27 and edge 29 can be made of different materials. In other words, a material having a physical property appropriate for a diaphragm is used for diaphragm 27; a material having a physical property appropriate for an edge is used for edge 29. Four examples are shown below.

Example 1

When a material thinner than that of diaphragm 27 is used for edge 29, hard and thicker diaphragm 27 reproduces high tones with high fidelity while expanding the higher limit frequency thereof. Thinner edge 29 allows voice coil 28 and diaphragm 27 to easily vibrate, lower the F0 of the speaker, and thus reproduce low tones with high fidelity.

Example 2

When a material softer than that of diaphragm 27 is used for edge 29, harder diaphragm 27 reproduces high tones with high fidelity while expanding the higher limit frequency thereof. Softer edge 29 allows voice coil 28 and diaphragm 27 to easily vibrate, lower the F0 of the speaker, and thus reproduce low tones with high fidelity.

Example 3

When material having larger internal loss than that of diaphragm 27 is used for edge 29, diaphragm 27 having smaller internal loss reproduces high tones with high fidelity while expanding the higher limit frequency thereof. Edge 29 having larger internal loss reduces unnecessary resonance of the edge and stabilizes the frequency characteristics.

Example 4

Disposing a tangential rib in edge 29 improves the vibrating characteristics of edge 29 and further reduces distortion.

In order for each of diaphragm 27 and edge 29 to exert its optimum characteristics, it is preferable that the diameter of the joint of diaphragm 27 and edge 29 does not exceed 70% of the outer diameter of edge 29. In other words, enlarging edge 29 can improve the performance of the speaker.

Second Exemplary Embodiment

Figure 2:
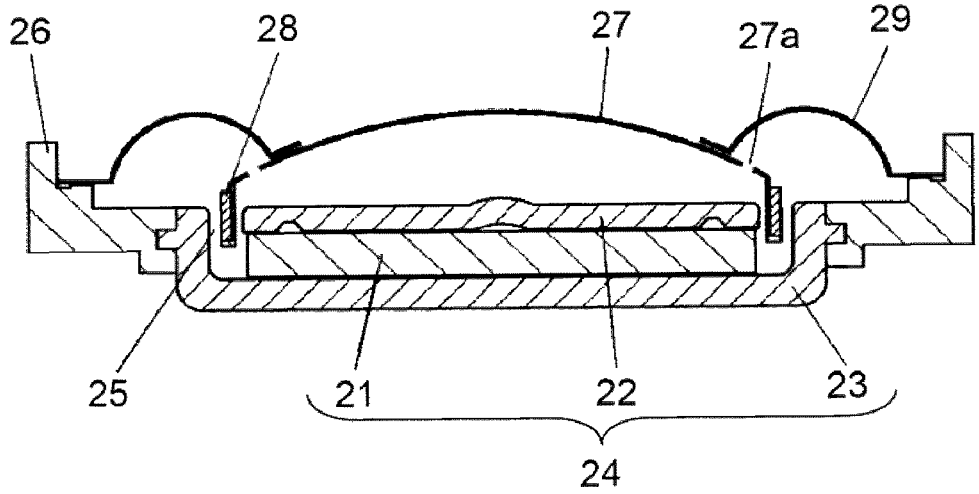
FIG. 2 is a sectional view of a speaker in accordance with a second exemplary embodiment of the present invention.

FIG. 2 is a sectional view of a speaker in accordance with the second exemplary embodiment of the present invention. A description is provided only of the difference from the first exemplary embodiment.

Through-hole 27*a* is provided in a portion of diaphragm 27 covered by edge 29. This structure allows communication of air in and out of a space enclosed by diaphragm 27 and upper plate 22 through through-hole 27*a*, thus allowing smooth vibration of diaphragm 27. This smooth vibration lowers the F0 of the speaker, improves the capability of reproducing low tones, and decreases distortion, thus improving the frequency characteristics.

When more smooth communication of air in and out of the enclosed space is desired, a through-hole can be provided through magnetic circuit 24 or frame 26 to allow the air to flow directly to the outside.

Third Exemplary Embodiment

Figure 3:
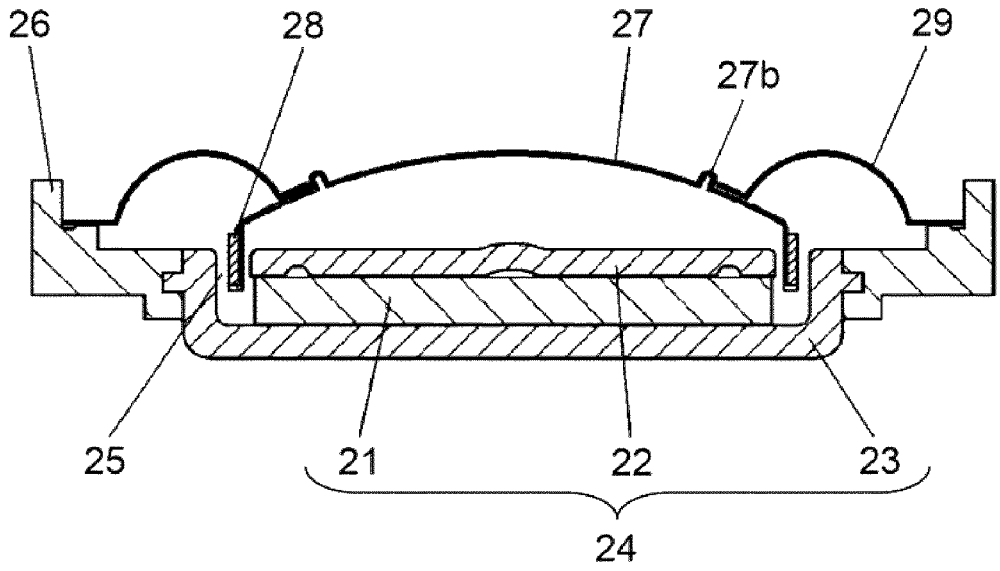
FIG. 3 is a sectional view of a speaker in accordance with a third exemplary embodiment of the present invention, showing an example of the shape of a guide.

FIGS. 3 through 7 are sectional views of speakers in accordance with the third exemplary embodiment of the present invention. A description is provided only of the difference from the first exemplary embodiment. As shown in FIG. 3, guide 27*b* is provided in the joint of diaphragm 27 and edge 29. This structure allows precise positioning of diaphragm 27 and edge 29 when they are being joined to each other.

Figure 4:
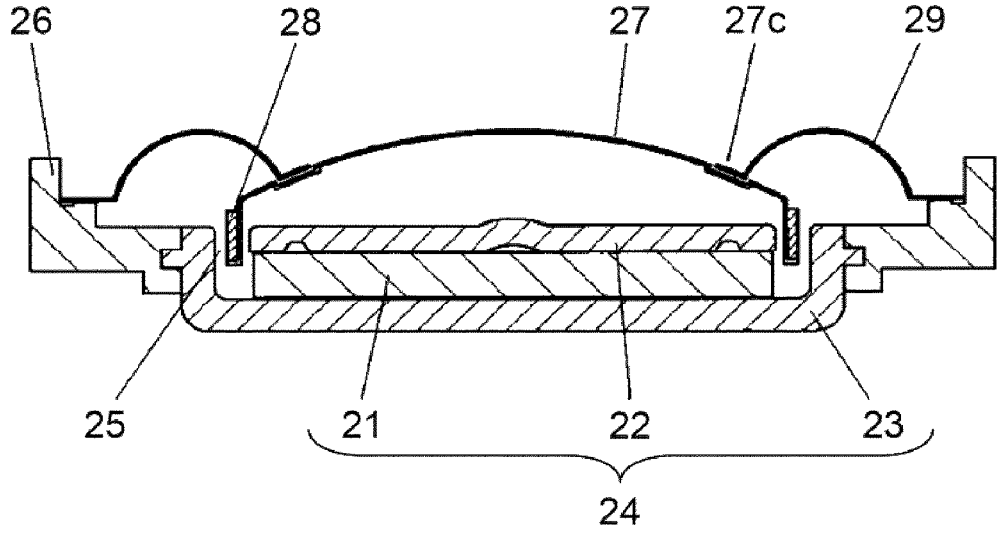
FIG. 4 is a sectional view of a speaker in accordance with the third exemplary embodiment of the present invention, showing another example of the shape of the guide.
Figure 5:
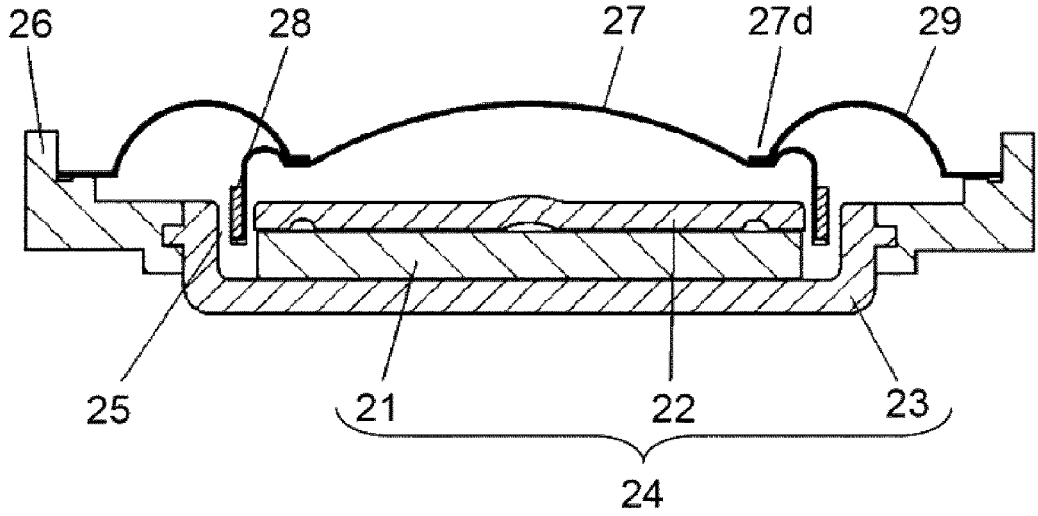
FIG. 5 is a sectional view of a speaker in accordance with the third exemplary embodiment of the present invention, showing still another example of the shape of the guide.
Figure 6:
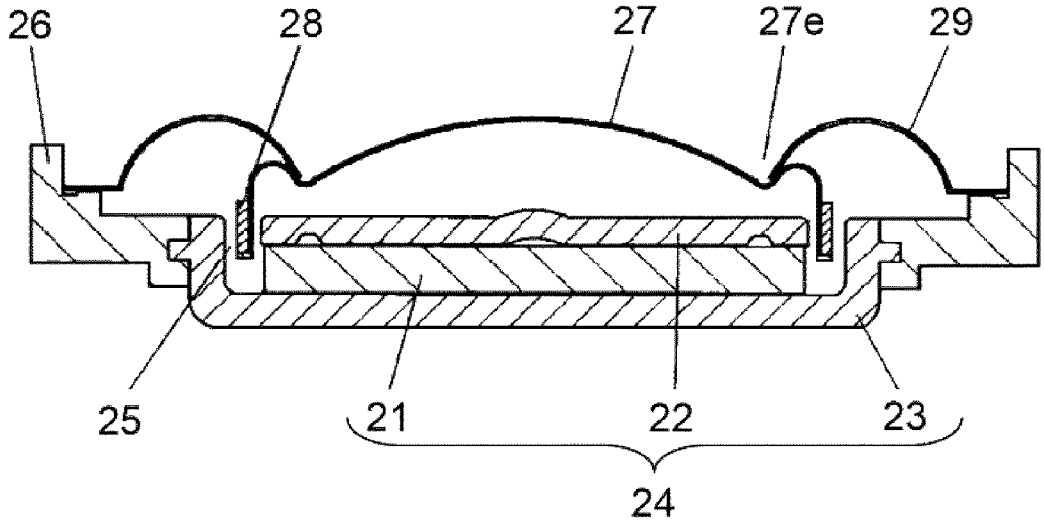
FIG. 6 is a sectional view of a speaker in accordance with the third exemplary embodiment of the present invention, showing yet another example of the shape of the guide.
Figure 7:
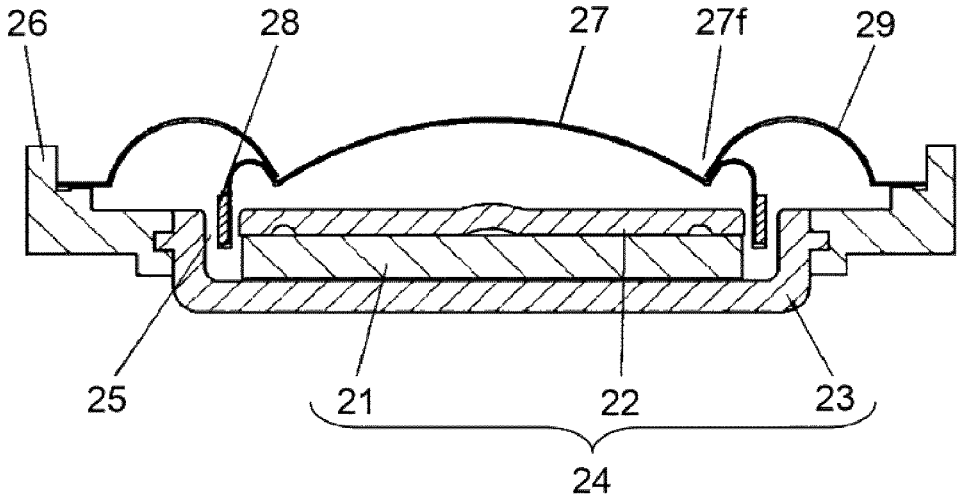
FIG. 7 is a sectional view of a speaker in accordance with the third exemplary embodiment of the present invention, showing still another example of the shape of the guide.

FIG. 4 shows recess 27*c*, as another example of the guide. FIG. 5 shows horizontal recess 27*d* as still another example of the guide. FIG. 6 shows recess 27*e* having a U-shaped section, as yet another example of the guide. FIG. 7 shows recess 27*f* having a V-shaped section, as still another example of the guide.

Fourth Exemplary Embodiment

Figure 8:
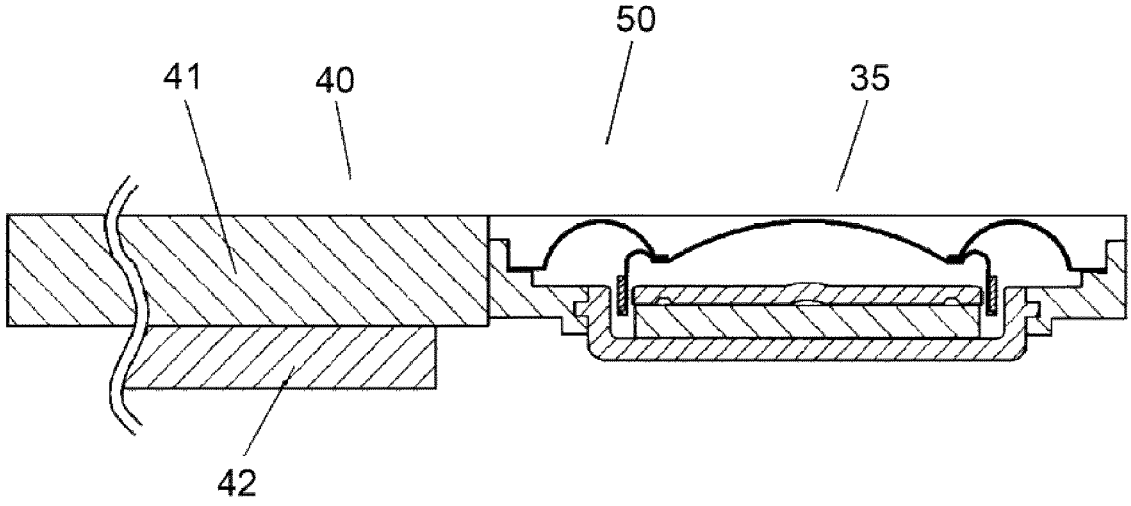
FIG. 8 is a sectional view of a speaker module in accordance with a fourth exemplary embodiment of the present invention.

FIG. 8 is a sectional view of a speaker module in accordance with the fourth exemplary embodiment of the present invention. Speaker module 50 is structured by integrating speaker 35 of the present invention and electronic circuit 40. Electronic circuit 40 is structured of circuit board 41 and electronic component 42. Because electronic circuit 40 has a circuit for amplifying voice signals to be supplied to speaker 35, only connecting speaker module 50 to a source of the voice signals can provide voice output.

Further, electronic circuit 40 may include: circuits necessary for communication, e.g. a detector circuit, modulator circuit, and demodulator circuit; a driver circuit for a display means, e.g. a liquid crystal display; and a power supply circuit and charging circuit.

Fifth Exemplary Embodiment

Figure 9:
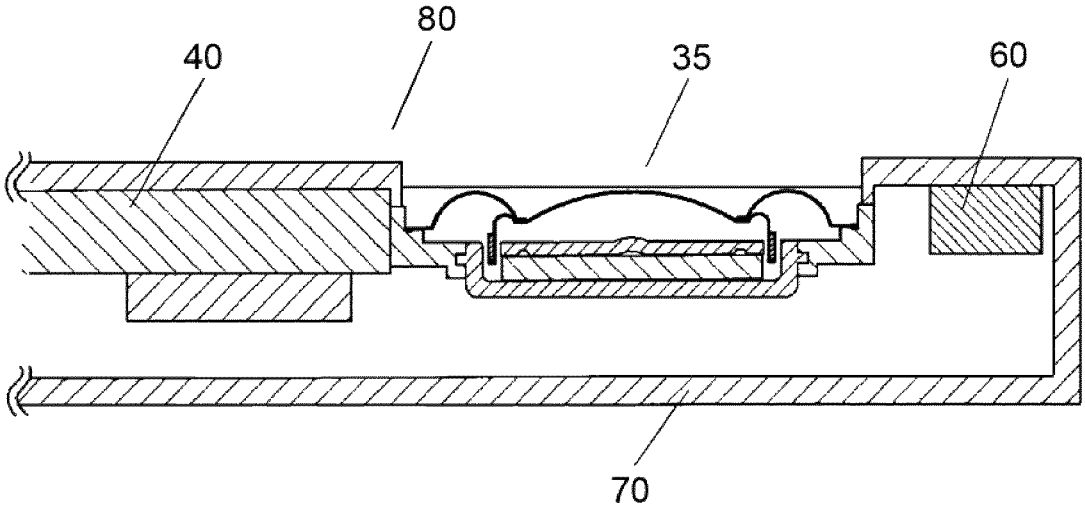
FIG. 9 is a sectional view of electronic equipment in accordance with a fifth exemplary embodiment of the present invention.

FIG. 9 is a sectional view of an essential part of a portable telephone (electronic equipment) in accordance with the fifth exemplary embodiment of the present invention. The electronic equipment, e.g. a portable telephone, incorporates speaker 35 of the present invention, electronic circuit 40, and display module 60, e.g. a liquid crystal display, inside of case 70.

Sixth Exemplary Embodiment

Figure 10:
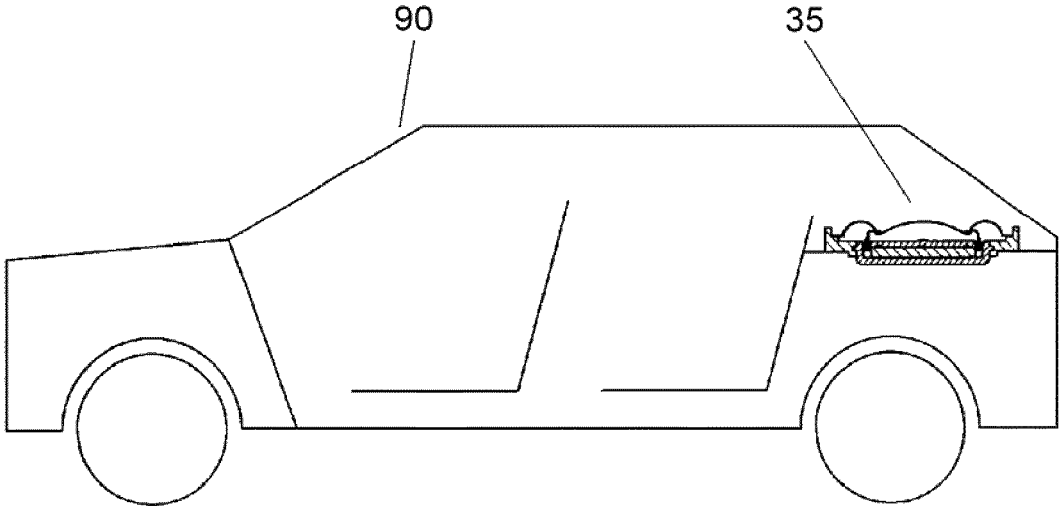
FIG. 10 is a sectional view of a device in accordance with a sixth exemplary embodiment of the present invention.

FIG. 10 is a sectional view of an automobile (device) in accordance with the sixth exemplary embodiment of the present invention. The device, e.g. automobile 90, incorporates speaker 35 of the present invention in a rear tray or front panel thereof to use the speaker as a part of a car navigation or car audio system.

Seventh Exemplary Embodiment

Figure 11:
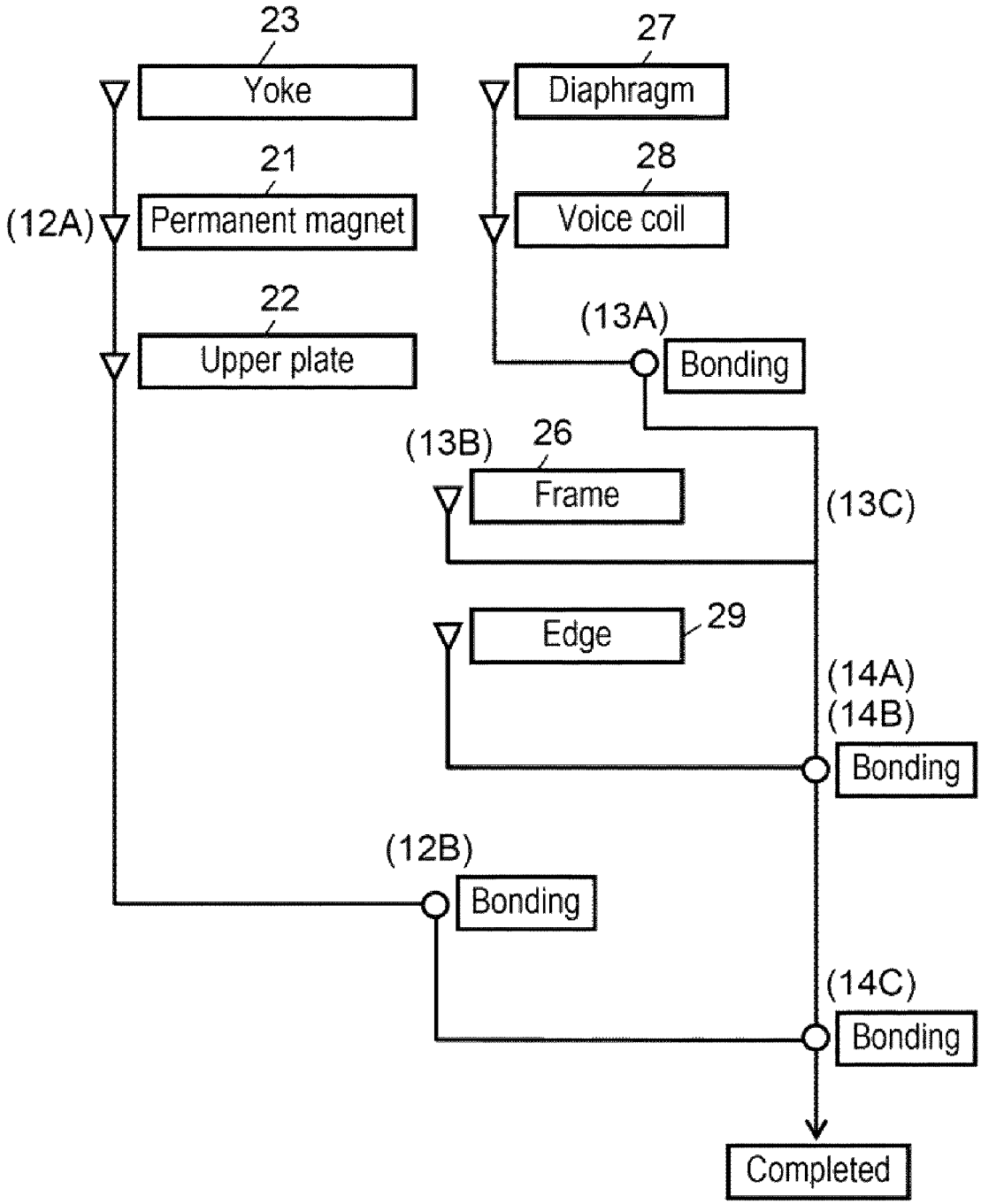
FIG. 11 shows steps 12A through 14C of manufacturing a speaker of the present invention.

FIG. 11 is a block diagram showing steps 12A through 14C of manufacturing a speaker (see FIG. 15) of the present invention.

Figure 12A:
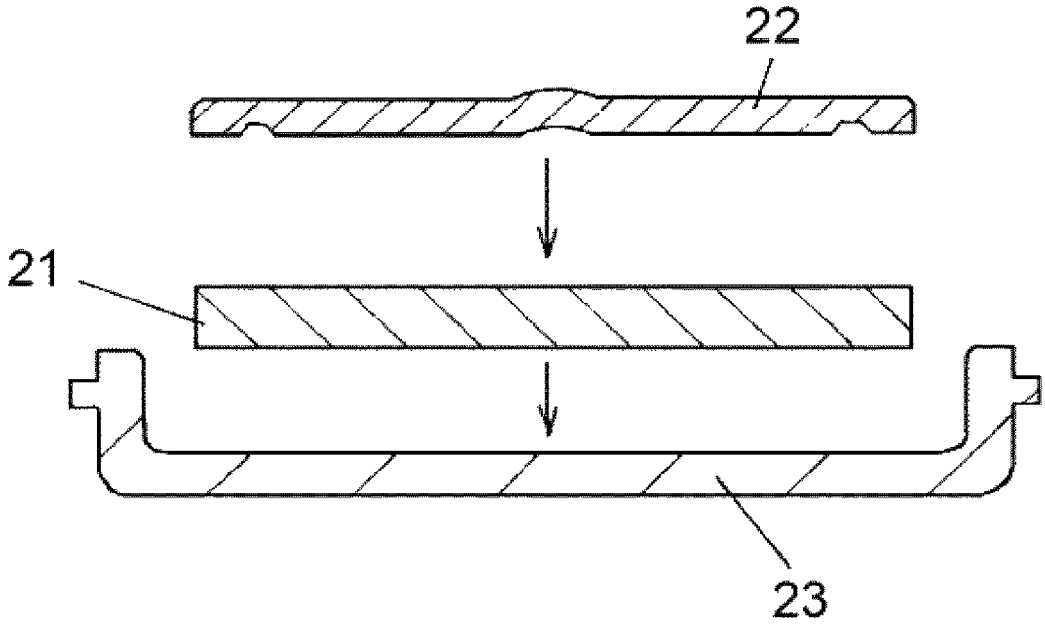
FIG. 12A shows step 12A of manufacturing the speaker of the present invention.
Figure 12B:
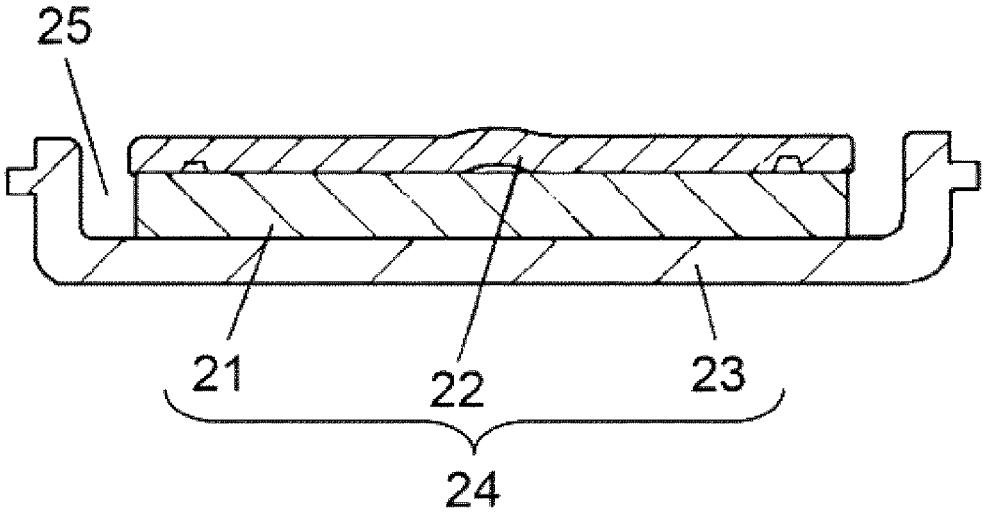
FIG. 12B shows step 12B of manufacturing the speaker of the present invention.

FIG. 12A shows manufacturing step 12A of FIG. 11. FIG. 12B shows manufacturing step 12B of FIG. 11. In step 12A, permanent magnet 21 and upper plate 22 are bonded to yoke 23. In step 12B, the bonding is performed with a cap gage (not shown) inserted in magnetic gap 25. Thus, magnetic circuit assembly 24 is formed.

Figure 13A:
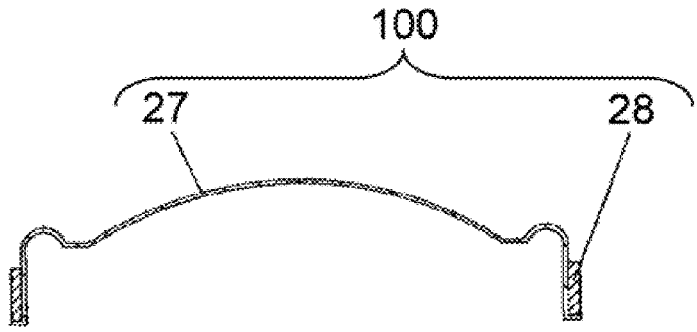
FIG. 13A shows step 13A of manufacturing the speaker of the present invention.
Figure 13B:
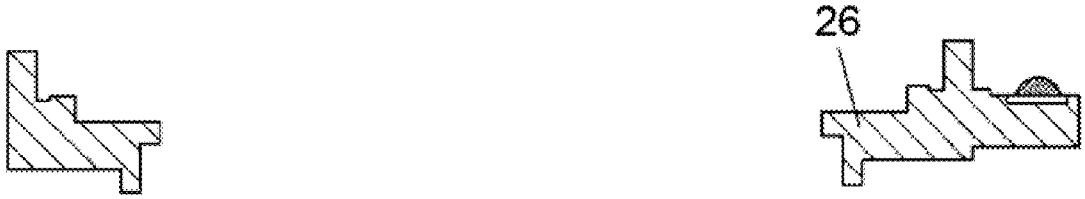
FIG. 13B shows step 13B of manufacturing the speaker of the present invention.
Figure 13C:
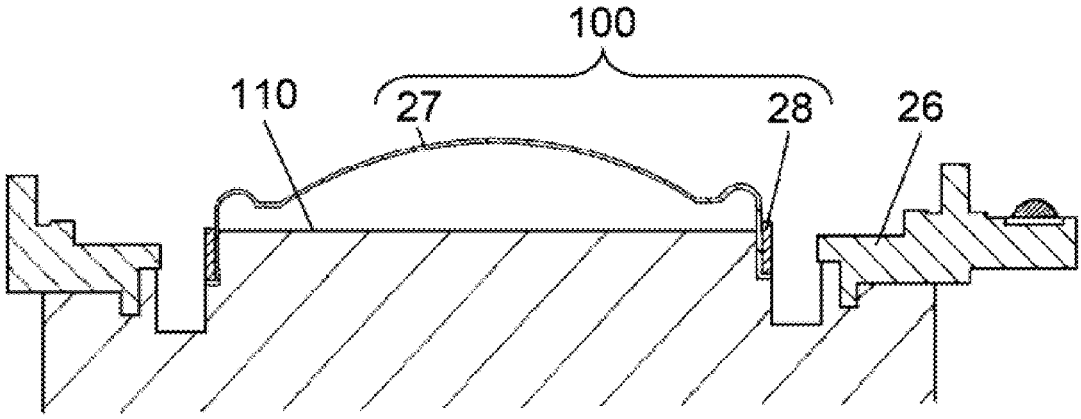
FIG. 13C shows step 13C of manufacturing the speaker of the present invention.

FIG. 13A shows manufacturing step 13A of FIG. 11. FIG. 13B shows manufacturing step 13B of FIG. 11. FIG. 13C shows manufacturing step 13C of FIG. 11. In step 13A, voice coil 28 is attached to diaphragm 27 obtained by pressing a resin sheet material into a shape to form diaphragm assembly 100. In step 13B, frame 26 made of a resin material is prepared. In step 13C, diaphragm assembly 100 and frame 26 are inserted into positioning jig 110 to be positioned precisely. In other words, as shown in FIG. 13C, positioning jig 110 positions the inner diameter of diaphragm assembly 100 and the inner diameter of frame 26 precisely.

Figure 14A:
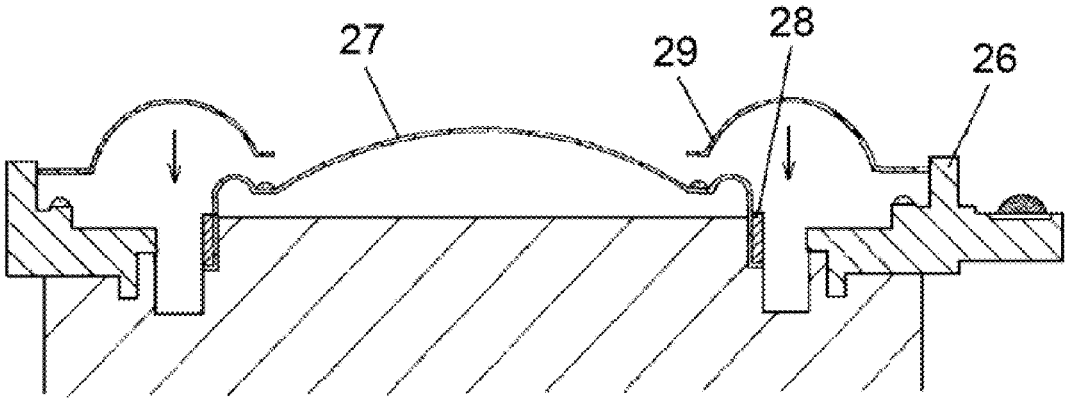
FIG. 14A shows step 14A of manufacturing the speaker of the present invention.
Figure 14B:
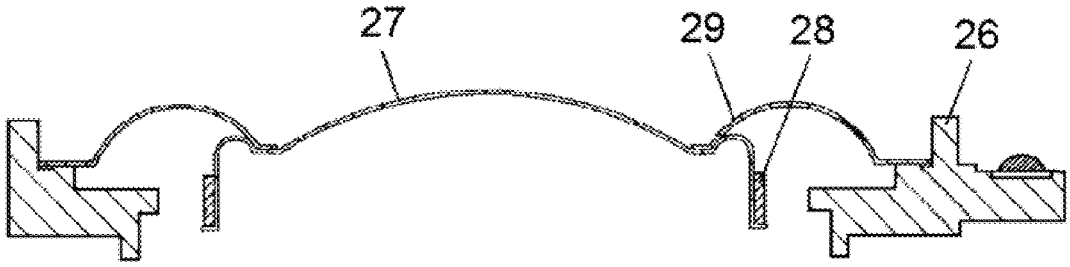
FIG. 14B shows step 14B of manufacturing the speaker of the present invention.
Figure 14C:
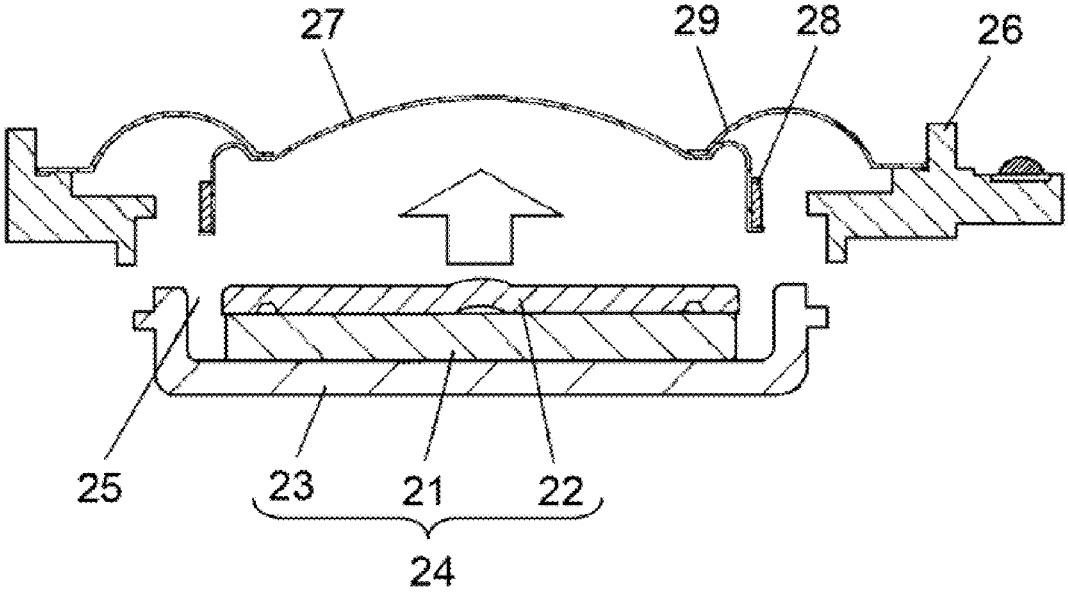
FIG. 14C shows step 14C of manufacturing the speaker of the present invention.
Figure 15:
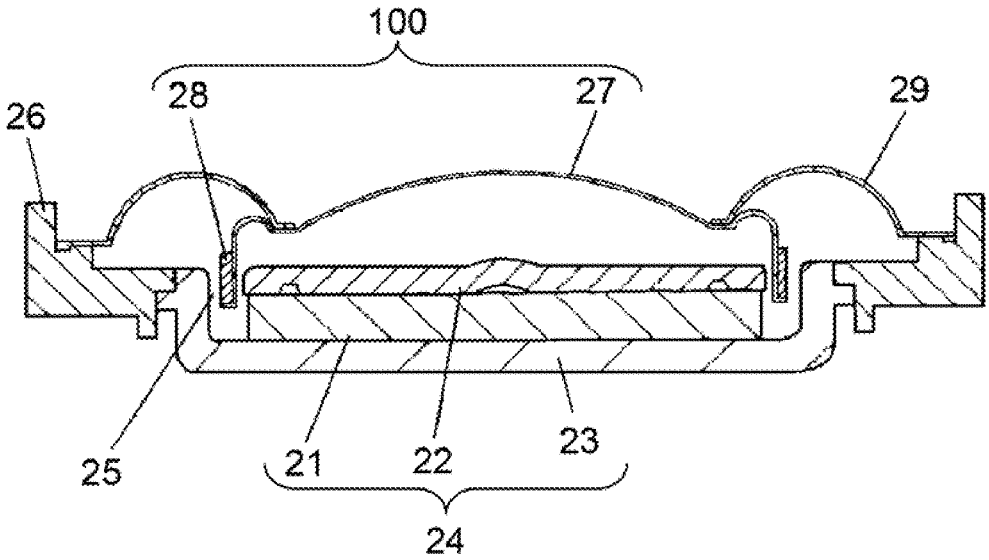
FIG. 15 is a sectional view of the speaker of the present invention.
Figure 15:
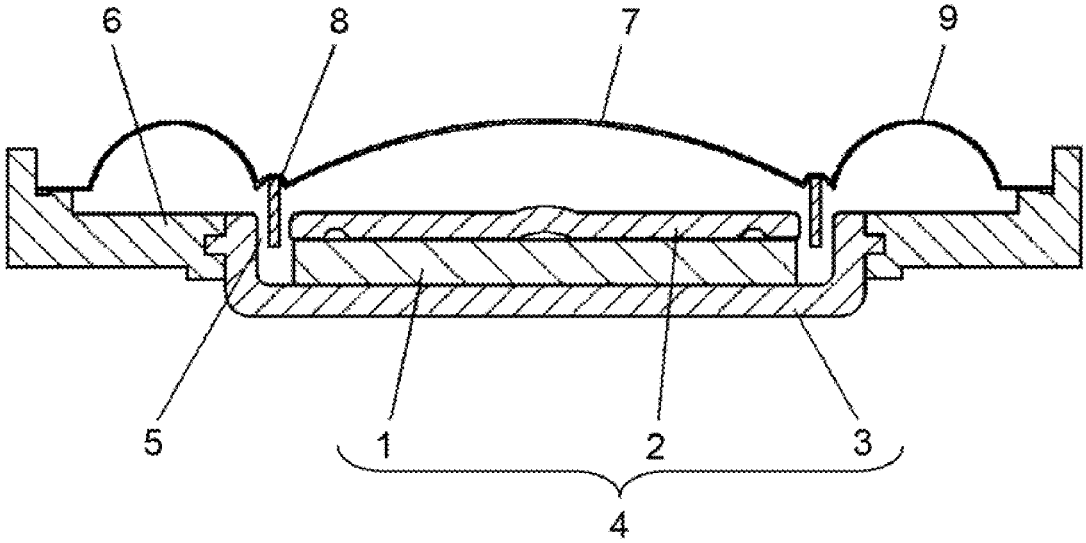

FIG. 14A shows manufacturing step 14A of FIG. 11. FIG. 14B shows manufacturing step 14B of FIG. 11. FIG. 14C shows manufacturing step 14C of FIG. 11. In step 14A, the outer periphery of edge 29 is bonded to frame 26, and the inner periphery of edge 29 is joined to diaphragm 27. In step 14B, positioning jig 110 is removed. In step 14C, in place of removed positioning jig 110, magnetic circuit assembly 24 obtained in step 12B is inserted and attached to frame 26. Thus, a speaker of the present invention shown in FIG. 15 is obtained.

INDUSTRIAL APPLICABILITY

A speaker of the present invention finds widespread application in electronic equipment requiring downsizing, such as audio visual equipment, telecommunication equipment, and game machines.

The invention claimed is:

1. A method of manufacturing a speaker comprising:

manufacturing a magnetic circuit assembly including a permanent magnet and a yoke, the magnetic circuit assembly having a magnetic gap between the permanent magnet and the yoke;

manufacturing a diaphragm assembly including a diaphragm and a voice coil attached to an outer periphery of the diaphragm;

positioning the diaphragm assembly and a frame on a positioning jig so that the voice coil attached to the diaphragm faces the frame with a predetermined distance therebetween;

coupling an edge to the diaphragm assembly and the frame, wherein an outer periphery of the edge is attached to the frame and an inner periphery of the edge is joined onto the diaphragm at a position more peripherally inward than the voice coil along an inner periphery thereof to partly overlap the diaphragm;

removing the positioning jig; and in place of the removed positioning jig, inserting and joining the magnetic circuit assembly to the frame so that the voice coil attached to the diaphragm is disposed in the magnetic gap.

2. The method of manufacturing the speaker of claim 1, wherein the positioning jig positions an inner diameter of the diaphragm assembly and an inner diameter of the frame.

* * * * *